US009033549B2

(12) United States Patent
Nussbaum et al.

(10) Patent No.: US 9,033,549 B2
(45) Date of Patent: May 19, 2015

(54) SURFACE MOUNT LIGHT WITH INTERCHANGEABLE DIFFUSERS

(75) Inventors: Jonathan Nussbaum, Miami, FL (US); William Scott Bourne, Boynton Beach, FL (US)

(73) Assignee: BELLALUZ LIGHTING, INC., Miami, FL (US)

( * ) Notice: Subject to any disclaimer, the term of this patent is extended or adjusted under 35 U.S.C. 154(b) by 312 days.

(21) Appl. No.: 13/606,990

(22) Filed: Sep. 7, 2012

(65) Prior Publication Data

US 2013/0063932 A1 Mar. 14, 2013

Related U.S. Application Data

(60) Provisional application No. 61/532,686, filed on Sep. 9, 2011, provisional application No. 61/659,803, filed on Jun. 14, 2012.

(51) Int. Cl.

| | |
|---|---|
| ***F21V 11/00*** | (2006.01) |
| ***F21V 21/00*** | (2006.01) |
| ***F21L 4/02*** | (2006.01) |
| ***F21S 6/00*** | (2006.01) |
| ***F21V 3/00*** | (2006.01) |
| *F21W 121/00* | (2006.01) |
| *F21W 131/301* | (2006.01) |
| *F21Y 101/02* | (2006.01) |

(52) U.S. Cl.

CPC . *F21S 6/002* (2013.01); *F21V 3/00* (2013.01); *F21W 2121/00* (2013.01); *F21W 2131/301* (2013.01); *F21Y 2101/02* (2013.01); *Y10S 362/806* (2013.01)

(58) Field of Classification Search

None

See application file for complete search history.

(56) References Cited

U.S. PATENT DOCUMENTS

| | | | | |
|---|---|---|---|---|
| 3,184,594 | A | 5/1965 | Siegel | |
| 6,746,136 | B1 | 6/2004 | Fung | |
| 7,314,293 | B2 | 1/2008 | Steier et al. | |
| 7,402,618 | B2 | 7/2008 | Xu | |
| 7,445,362 | B2 | 11/2008 | Compton et al. | |
| 8,750,671 | B1 * | 6/2014 | Kelly et al. | 385/146 |
| 2005/0007783 | A1 * | 1/2005 | Ono | 362/294 |
| 2005/0024862 | A1 | 2/2005 | Laux | |
| 2006/0023460 | A1 | 2/2006 | Steier et al. | |
| 2007/0206384 | A1 | 9/2007 | Compton et al. | |
| 2010/0026157 | A1 * | 2/2010 | Tanaka et al. | 313/45 |

* cited by examiner

*Primary Examiner* — Ashok Patel

(74) *Attorney, Agent, or Firm* — Roeder & Broder LLP

(57) ABSTRACT

A surface mount light (10) comprises a base assembly (12) and a first diffuser (14). The base assembly (12) includes (i) a housing body (25) having a base (16) and a side (18) that is coupled to the base (16), the base (16) being mountable on a surface (15); (ii) a light assembly (22) positioned substantially within the housing body (25), the light assembly (22) including one or more LED lights (34), wherein power is selectively provided to the light assembly (22) such that at least one of the one or more LED lights (34) directs light away from the base (16); and (iii) a first attachment member (40). The first diffuser (14) includes a second attachment member (42) that selectively engages the first attachment member (40) to selectively attach the first diffuser (14) to the base assembly (12) without damaging the base assembly (12) and the first diffuser (14).

12 Claims, 7 Drawing Sheets

SURFACE MOUNT LIGHT WITH INTERCHANGEABLE DIFFUSERS

RELATED INVENTIONS

This application claims priority on U.S. Provisional Application Ser. No. 61/532,686, filed Sep. 9, 2011 and entitled "SURFACE MOUNT LIGHT WITH INTERCHANGEABLE DIFFUSERS"; and on U.S. Provisional Application Ser. No. 61/659,803, filed Jun. 14, 2012 and entitled "SURFACE MOUNT LIGHT WITH INTERCHANGEABLE DIFFUSERS". As far as permitted, the contents of U.S. Provisional Application Ser. Nos. 61/532,686 and 61/659,803 are incorporated herein by reference.

BACKGROUND

Lights and lighting that are designed to be mounted to a surface, e.g., a table top, a desk top, a counter top, a wall, or the underside of a cabinet, can provide useful illumination of various areas in and around homes and buildings. Additionally, such lights can also be used for decorative purposes, such as for celebrating holidays, birthdays or other occasions, or for supporting favorite teams, fictional characters or causes. Unfortunately, in many instances, the time and effort required to switch decorative lights between holidays, sports seasons, or other celebrations can cause many to not want to utilize such decorative lights on a regular basis.

SUMMARY

The present invention is directed toward a surface mount light that is mounted on a surface, the surface mount light comprising a base assembly and a first diffuser. In certain embodiments, the base assembly includes (i) a housing body having a base and a side that is coupled to the base, the base being adapted to be mounted on the surface; (ii) a light assembly that is positioned substantially within the housing body, the light assembly including one or more LED lights, wherein power is selectively provided to the light assembly such that at least one of the one or more LED lights directs light away from the base; and (iii) a first attachment member. Additionally, the first diffuser can be selectively attached to and detached from the base assembly without damaging the base assembly and the first diffuser. Moreover, the first diffuser includes a second attachment member that selectively engages the first attachment member so that the first diffuser is selectively attachable to the base assembly. In one such embodiment, the first attachment member includes a groove that extends around a perimeter of the housing body, and the second attachment member includes one or more protrusions that can be selectively positioned within the groove.

In some embodiments, the housing body is substantially disk shaped. In one such embodiment, the housing body has a diameter of less than approximately five inches.

Additionally, in one embodiment, the first diffuser is a decorative diffuser that extends away from the base assembly by at least approximately two inches.

In one embodiment, the surface mount light further comprises a second diffuser that is selectively attachable to and detachable from the base assembly.

In certain embodiments, the surface mount light further comprises a switch that selectively activates the light assembly. Additionally, the surface mount light can further comprise a sound source positioned substantially within the housing body. Moreover, in one embodiment, the switch selectively activates the sound source.

Further, in one embodiment, the surface mount light further comprises a power source assembly including one or more batteries that selectively provide power to the light assembly such that at least one of the one or more LED lights directs light away from the base.

Additionally, the present invention is also directed toward a package assembly including the surface mount light as described above, and a second diffuser that is alternatively selectively attachable to and detachable from the base assembly without damaging the base assembly and the second diffuser.

Further, in another embodiment, the present invention is directed toward a surface mount light that is mounted on a surface, the surface mount light comprising (a) a base assembly including (i) a housing body having a base and a side that is coupled to the base, the base being adapted to be mounted on the surface; and (ii) a light assembly that is positioned substantially within the housing body, the light assembly including one or more LED lights, wherein power is selectively provided to the light assembly such that at least one of the one or more LED lights directs light away from the base; and (b) a sound source that is positioned substantially within the housing body, wherein power is selectively provided to the sound source to selectively activate the sound source.

Still further, in yet another embodiment, the present invention is directed toward a surface mount light that is mounted on a surface, the surface mount light comprising (a) a base assembly including (i) a housing body having a base and a side that is coupled to the base, the base being adapted to be mounted on the surface; (ii) a light assembly that is positioned substantially within the housing body, the light assembly including one or more LED lights; (iii) a power source assembly that provides power to the light assembly such that at least one of the one or more LED lights directs light away from the base; and (iv) a first attachment member; (b) a sound source that is positioned substantially within the housing body, the power source assembly providing power to the sound source to selectively activate the sound source; (c) a first diffuser that is selectively attachable to and detachable from the base assembly without damaging the base assembly and the first diffuser, the first diffuser including a second attachment member that selectively engages the first attachment member so that the first diffuser is selectively attachable to the base assembly; and (d) a second diffuser that is selectively attachable to and detachable from the base assembly without damaging the base assembly and the second diffuser.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
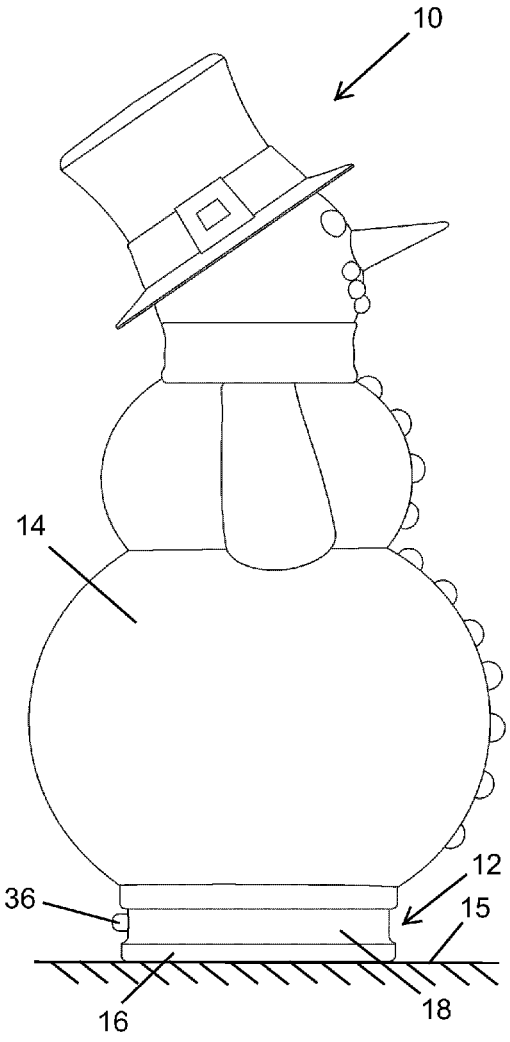
FIG. 1A is a simplified side view of an embodiment of a surface mount light having features of the present invention.
Figure 1B:
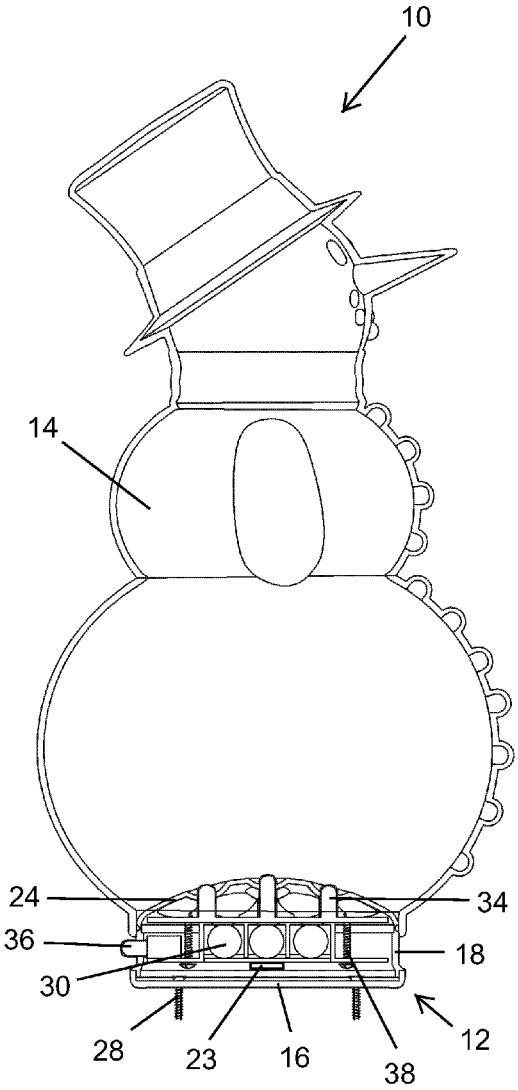
FIG. 1B is a sectional side view of the surface mount light illustrated in FIG. 1A.
Figure 1C:
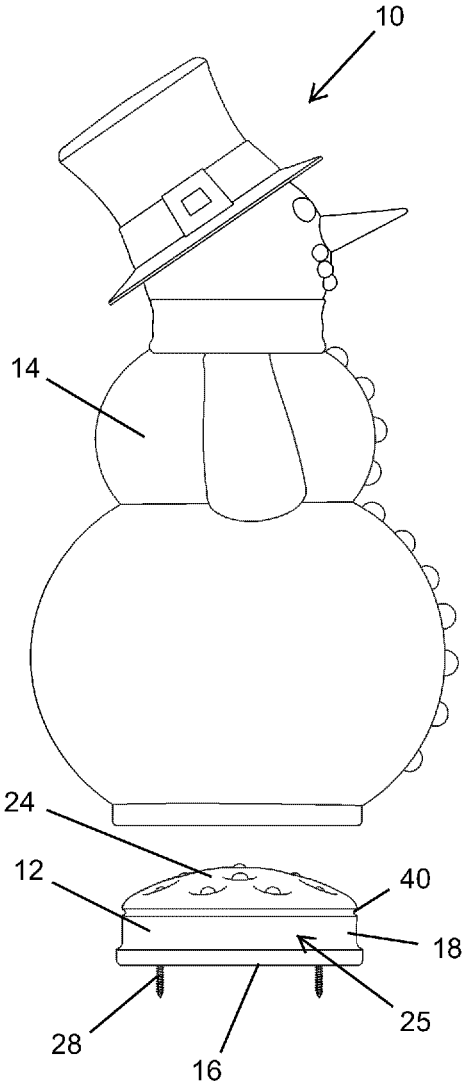
FIG. 1C is a partially exploded side view of the surface mount light illustrated in FIG. 1A.
Figure 1D:
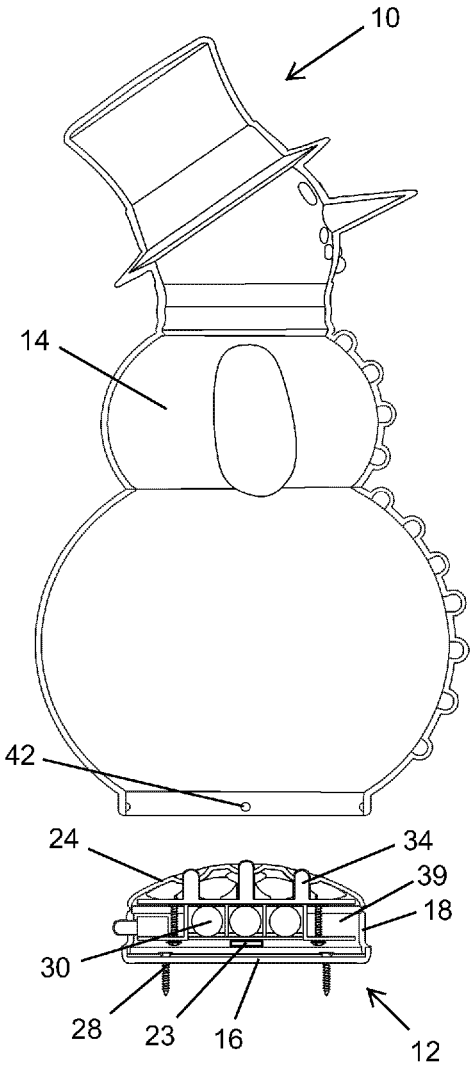
FIG. 1D is a partially exploded sectional side view of the surface mount light illustrated in FIG. 1A.
Figure 1E:
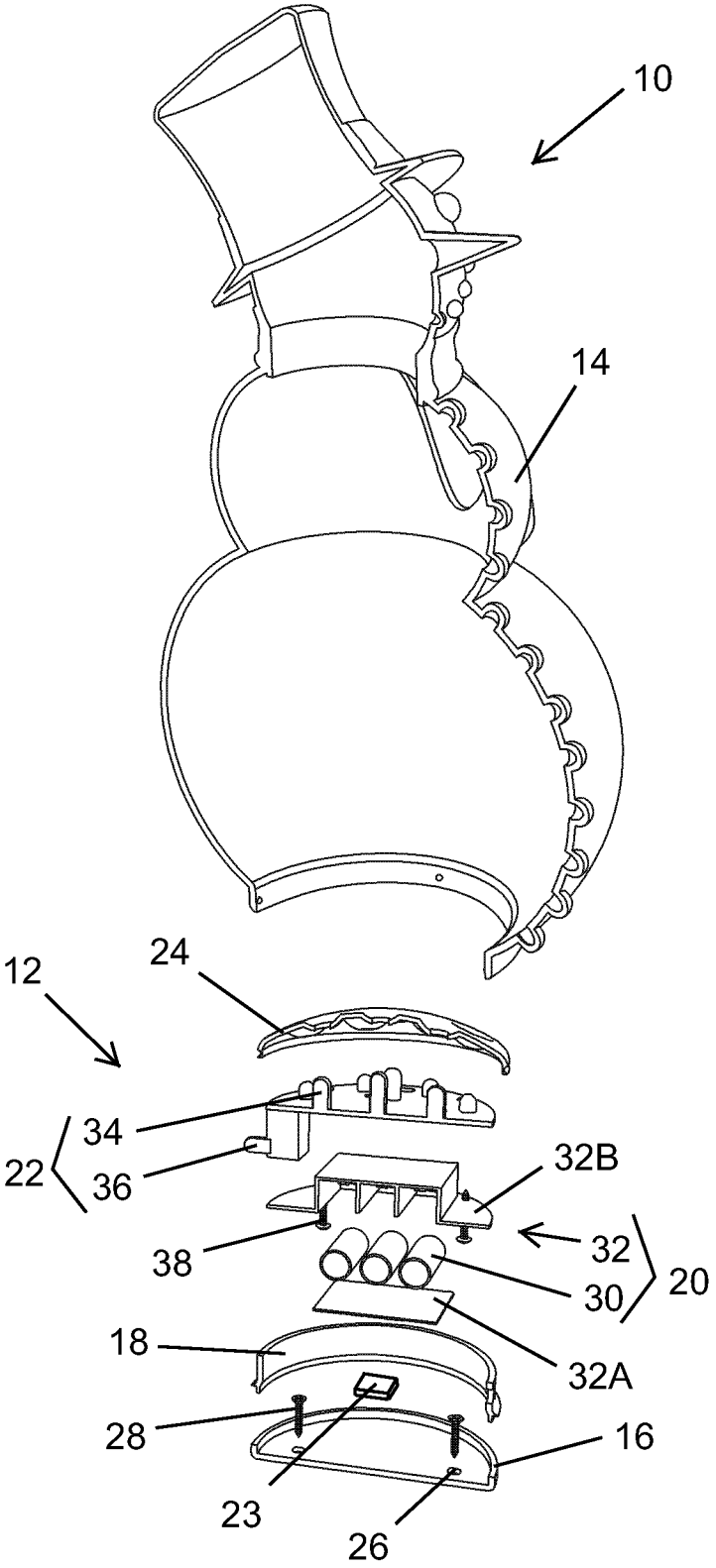
FIG. 1E is an exploded sectional perspective view of the surface mount light illustrated in FIG. 1A.

FIGS. 1A-1E are alternative views of an embodiment of a surface mount light 10 having features of the present invention. More particularly, FIG. 1A is a simplified side view of the surface mount light 10; FIG. 1B is a sectional side view of the surface mount light 10 illustrated in FIG. 1A; FIG. 1C is a partially exploded side view of the surface mount light 10 illustrated in FIG. 1A; FIG. 1D is a partially exploded sectional side view of the surface mount light 10 illustrated in FIG. 1A; and FIG. 1E is an exploded sectional perspective view of the surface mount light 10 illustrated in FIG. 1A.

As illustrated in this embodiment, the surface mount light 10 can include a base assembly 12 and a diffuser 14 that is selectively attached to the base assembly 12. Alternatively, the surface mount light 10 can be designed to function without the need for the diffuser 14, i.e. the surface mount light 10 can function with only the base assembly 12.

As an overview, the surface mount light 10 is designed such that the diffuser 14 can be quickly, easily and selectively attached to and detached from the base assembly 12, without damaging the base assembly 12 and/or the diffuser 14. Stated in another fashion, the surface mount light 10 is designed such that the diffuser 14 is removably attachable to the base assembly 12, without damaging the base assembly 12 and/or the diffuser 14. Additionally, the diffuser 14 can be selectively attached to and detached from the base assembly 12 without having to remove the surface mount light 10 from a surface 15, e.g., a table top, a desk top, a counter top, a wall, an underside of a cabinet, etc. on which the surface mount light 10 is mounted. Further, the surface mount light 10 can include a plurality of diffusers 14 (e.g., the diffuser 14 illustrated in FIGS. 1A-1I, the diffuser 214 illustrated in FIGS. 2A-2D, and the diffuser 314 illustrated in FIGS. 3A and 3B) which can each alternatively be quickly, easily and selectively attached to and detached from the base assembly 12. With this design, the plurality of diffusers 14 can be quickly, easily and selectively interchanged so that the surface mount light 10 can be used for various different holidays, sports seasons, or other celebrations without the need to provide an entirely new surface mount light 10. Moreover, this further saves added expenses and storage space that may be required in order to have and utilize completely different surface mount lights 10 for each new occasion. Still further, it should be noted that the surface mount light 10 can be provided as part of a package assembly (see e.g., the package assembly 550 illustrated in FIG. 5) that includes a base assembly 12 and a plurality of diffusers 14, with each of the plurality of diffusers 14 being selectively and alternatively attachable to and detachable from the base assembly 12, without damaging the base assembly 12 and/or the diffusers 14.

Additionally, as illustrated, the surface mount light 10 can further include a sound source 23 that can be positioned substantially within, near and/or adjacent to the base assembly 12. The sound source 23 can provide sound that can be selectively turned on or off within the surface mount light 10. In one embodiment, the sound source 23 can be selectively controlled to play a portion of a song, or a full song whenever the surface mount light 10 is turned on. Alternatively, the sound source 23 can continuously play songs while the surface mount light 10 is turned on and stop when the surface mount light 10 is turned off. Still alternatively, the sound source 23 can play songs for an adjustable, predetermined time whenever the surface mount light 10 is turned on. Yet alternatively, the sound source 23 can speak, e.g., say some words or phrases, that may (or may not) specifically relate to the diffuser 14 that is attached to the base assembly 12, whenever the surface mount light 10 is turned on. Still yet alternatively, the sound source 23 can play words, songs, etc. that have been specifically recorded by the user (or from another source) to be used with the surface mount light 10.

In one embodiment, the sound source 23 has a memory of the songs or phrases. Alternatively, as a non-exclusive example, the sound source 23 can include a radio tuner to tune into a radio station.

The design of the base assembly 12 can be varied to suit the specific design requirements of the surface mount light 10. For example, in one non-exclusive embodiment, the base assembly 12 can comprise an LED puck light. LED puck lights utilize one or more LED lights and typically include a substantially circular (i.e. disk) or oval shape. Additionally, LED puck lights are good for and, thus, are commonly used for under-cabinet and display lighting purposes. Alternatively, the base assembly 12 can have a different design.

In this embodiment, as best shown in FIG. 1E, the base assembly 12 can include a base 16, a side 18, a power source assembly 20, a light assembly 22, the sound source 23, and a cover 24. Alternatively, the base assembly 12 can be designed without one or more of the elements noted above. For example, the base assembly 12 can be designed without the cover 24. Still alternatively, the base assembly 12 can include additional features not specifically illustrated in the Figures.

It should be noted that the base 16, the side 18 and/or the cover 24 can be referred to as individual elements of a housing body 25. Stated another way, in certain embodiments, the housing body 25 includes the base 16, the side 18 and the cover 24.

The base 16 is adapted to be fixedly and/or detachably secured to or otherwise mounted on the surface 15, such as a counter top, a desk top, a table top, a wall, and/or the underside of a cabinet. Stated in another fashion, during use, the base 16 is positioned substantially adjacent to, if not in direct contact with, the surface 15 on which the surface mount light 10 is attached and/or mounted. For example, in one embodiment, as shown most clearly in FIG. 1E, the base 16 can include one or more base apertures 26 (two are illustrated in FIG. 1E). Further, the surface mount light 10 can include a one or more base attachers 28 (two are illustrated in FIGS. 1B-1E), e.g., screws, that extend through the base apertures 26 and into the surface 15 on which the surface mount light 10 is to be mounted. Alternatively, the base 16 can be designed with more or less than the two base apertures 26 specifically illustrated in FIG. 1E, and/or the surface mount light 10 can include more or less than the two base attachers 28 specifically illustrated in FIGS. 1B-1E. Additionally and/or alternatively, the design of the base attachers 28 can be different than specifically illustrated in FIGS. 1B-1E. For example, in one non-exclusive alternative embodiment, the base 16 can be designed without any base apertures 26 and the base attachers 28 can include one or more magnets that can be secured to the base 16 and/or mounted to the surface 15. Still alternatively, the base 16 can be attached to and/or mounted on the surface 15 with two-sided tape, with hook and loop material secured to the base 16 and the surface 15, or by other appropriate attachment means.

The size and shape of the base 16 can be varied depending on the design requirements of the surface mount light 10. In certain embodiments, as shown, the base 16 can be substantially circular in shape, and the base 16 can have a diameter of between approximately two inches and five inches. For example, in some particular non-exclusive embodiments, the base 16 can have a diameter of approximately 2.0, 2.5, 3.0, 3.5, 4.0, 4.5 or 5.0 inches. Alternatively, the base 16 can have a different shape and/or a different size. For example, the base 16 can be substantially square shaped, rectangle shaped, triangle shaped, oval shaped, octagon shaped, or some other shape; and/or the base 16 can have a diameter that is greater than five inches or less than two inches.

The side 18 is coupled to the base 16 and extends away from the base 16 and away from the surface 15 on which the base 16 is mounted. Moreover, the side 18 can have a size and shape that corresponds with the size and shape of the base 16 to which the side 18 is coupled. In this embodiment, the side 18 is substantially annular ring shaped to match the substantially circular shaped base 16. With this design, the housing body 25 is substantially disk shaped. In some particular non-exclusive embodiments, the housing body 25 can have a diameter of approximately 2.0, 2.5, 3.0, 3.5, 4.0, 4.5 or 5.0 inches. Alternative, the housing body 25 can have a diameter that is greater than five inches or less than two inches. Still alternatively, the side 18 (and, thus, the housing body 25) can have a different design and/or have a different shape. For example, in certain non-exclusive alternative embodiments, the side 18 can be a ring that is substantially square shaped, rectangle shaped, triangle shaped, oval shaped, octagon shaped, or some other shape.

The power source assembly 20 provides power to the surface mount light 10, i.e. to the light assembly 22 and/or the sound source 23, in order to illuminate the light assembly 22 and/or to generate sound from the sound source 23. As shown, the power source assembly 20 can include a power source 30, and a power source housing 32. In one embodiment, as illustrated, the power source 30 can include one or more batteries in order to provide sufficient electrical power to illuminate the light assembly 22 and/or to generate sound from the sound source 23. Alternatively, the power source 30 can include one or more wires that enable the surface mount light 10 to be electrically connected to a remote power system in order to provide sufficient electrical power to illuminate the light assembly 22 and/or generate sound from the sound source 23. Still alternatively, the power source 30 can be designed to provide power to the surface mount light 10 in a different manner.

The power source housing 32 isolates and/or protects the power source 30 from other elements of the surface mount light 10. For example, as illustrated herein, the power source housing 32 can include a battery support 32A and a battery cover 32B that isolate and/or protect the power source 30 from other elements of the surface mount light 10.

Additionally, at least a portion of the power source assembly 20 can be positioned substantially between the base 16 and the light assembly 22 to maintain the light assembly 22 spaced apart from the base 16. By spacing the light assembly 22 apart from the base 16, any heat generated by the light assembly 22 can be more easily directed away from the base 16 and thus away from the surface 15 to which the base 16 is attached or mounted.

The light assembly 22 can include one or more lights 34 that provide the desired illumination. For example, as illustrated, the light assembly 22 can include one or more LED lights 34 that individually extend away from the base 16, and, thus, direct light away from the base 16. In certain non-exclusive alternative embodiments, the light assembly 22 can include nine, eleven, thirteen, fifteen or seventeen LED lights. Alternatively, the light assembly 22 can include another suitable number of LED lights. Still alternatively, the light assembly 22 can include one or more different types of lights, e.g., incandescent lights and/or fluorescent lights.

Additionally, as illustrated, the light assembly 22 can include a switch 36 to selectively activate the lights 34. More specifically, the switch 36 can be moved between an on position, wherein the power source 30 provides power to the lights 34 so that the lights 34 can generate and/or provide the desired illumination, and an off position, wherein the power source 30 is not providing power to the lights 34. Alternatively, in certain embodiments, the surface mount light 10 can include a switch that is positioned remotely from the remainder of the surface mount light 10. For example, in embodiments that utilize a wired connection to provide power to the lights 34, the surface mount light 10 can utilize a wall-mounted switch. Still alternatively, the lights 34 can be turned on and off in a different manner, e.g., the lights 34 can be turned on and off due to the presence of a motion sensor (not illustrated), or the lights 34 can be turned on and off simply by providing a force on the base assembly 12 (i.e. the light assembly 22 can comprise a push light type lighting assembly). Additionally and/or alternatively, the power source 30 can further include a timer (not illustrated) such that the lights 34 can be turned on for a predetermined amount of time.

Further, the surface mount light 10 can include one or more assembly attachers 38, e.g., screws, to secure and/or couple the power source assembly 20 to the light assembly 22. More particularly, in one embodiment, the assembly attachers 38 can extend through the power source housing 32 and into the light assembly 22. Alternatively, the assembly attachers 38 can have a different design and/or the power source assembly 20 can be secured and/or coupled to the light assembly 22 in a different manner.

The sound source 23, as noted above, can be positioned substantially within, near and/or adjacent to the base assembly 12. In particular, in one non-exclusive embodiment, the sound source 23 can be positioned within the base assembly 12 and substantially adjacent to the base 16 of the base assembly 12. Moreover, the sound source 23 can provide sound that can be selectively activated within the surface mount light 10. Additionally, the sound source 23 can be turned on and off in a similar manner or a different manner in comparison to how the lights 34 are turned on and off. For example, the sound source 23 can be turned on and off using the same switch 36 that is used to selectively activate the lights 34. Alternatively, the sound source 23 can be activated using a different switch that is positioned substantially within and/or adjacent to the base assembly 12, or the sound source 23 can be activated using a different switch that is positioned remotely from the remainder of the surface mount light 10. Still alternatively, the sound source 23 can be turned on and off in a different manner, e.g., the sound source 23 can be turned on and off due to the presence of a motion sensor, or in another suitable manner.

The sound source 23 can have any suitable design that enables the sound source 23 to produce sound that can be used with the surface mount light 10. Moreover, the sound source 23 can be utilized to produce different types of sound with the surface mount light 10. For example, in certain non-exclusive embodiments, the sound source 23 can provide a song that is appropriate for the particular occasion that is being celebrated, and/or the sound source 23 can provide a voice as if the fictional character on the diffuser 14 is talking or singing. Further, the sound source 23 can include commercially produced sound, sound specifically provided by the consumer (or other suitable person), a radio tuner, or other appropriate sound source.

The cover 24 is positioned over the light assembly 22 and enables the illumination from the light assembly 22 to shine through. Additionally, in this embodiment, the cover 24 is coupled to the side 18 and/or the base 16 so that the light assembly 22 and the power source assembly 20 are positioned substantially within and are effectively maintained within a cavity 39 defined by the cover 24, the side 18 and the base 16. Stated in another fashion, the light assembly 22 and the power source assembly 20 are positioned substantially within and are effectively maintained within the cavity 39 defined by the housing body 25. With this design, the base 16, the side 18 and the cover 24, i.e. the housing body 25, provide a base housing for the other elements of the surface mount light 10.

Additionally, as illustrated, the base assembly 12 includes a first attachment member 40, and the diffuser 14 includes a second attachment member 42 that selectively engages the first attachment member 40 such that the diffuser 14 can be selectively and removably attached to the base assembly 12, i.e. selectively attached to and detached from the base assembly 12, without damaging the base assembly 12 and/or the diffuser 14. For example, as best illustrated in FIG. 1C, the cover 24 and the side 18 can cooperate to form the first attachment member 40, e.g., a narrow groove, around the perimeter of the base housing to receive a portion of the diffuser 14. In particular, in this embodiment, the diffuser 14 includes the second attachment member 42, e.g., one or more protrusions (illustrated in FIG. 1D), or bumps, that can be quickly and easily positioned within and/or be removed from the groove 40 without damaging the cover 24, the side 18 and/or the diffuser 14. Alternatively, the diffuser 14 can be detachably secured to the base assembly 12 in a different manner. For example, the diffuser 14 can include a groove and the cover 24 and/or the side 18 can include a one or more protrusions or bumps, wherein the protrusions (or bumps) can easily fit within and/or be removed from the groove of the diffuser 14. Still alternatively, the second attachment member 42 of the diffuser 14 can include a lip that fits within the first attachment member 40, e.g., the groove, and/or the first attachment member 40 and the second attachment member 42 can include one or more magnets can be secured to the base assembly 12 and the diffuser 14, respectively, for selectively and removably attaching the diffuser 14 to the base assembly 12. Yet alternatively, the first attachment member 40 and the second attachment member 42 can have a different suitable design that enables the diffuser 14 to be selectively and removably attached to and detached from the base assembly 12 without damaging the base assembly 12 and/or the diffuser 14.

Further, in certain embodiments, the base housing, i.e. the base 16, the side 18 and the cover 24, can be made from a durable, molded plastic material. Alternatively, the base 16, the side 18 and/or the cover 24 can be made from other suitable materials.

The design of the diffuser 14 can be varied to suit the specific design requirements of the surface mount light 10. For example, in certain non-exclusive embodiments, the diffuser 14 can be a decorative diffuser that is representative of and/or used for celebrating holidays, birthdays or other occasions, or for supporting favorite teams, fictional characters or causes, or other appropriate uses. Moreover, in some embodiments, the diffuser 14 can be a decorative diffuser that can extend away from the base assembly 12 by at least approximately two inches. For example, in some such non-exclusive embodiments, the diffuser 14 can be a decorative diffuser that extends away from the base assembly 12 by at least approximately 2.0, 2.5, 3.0, 3.5, 4.0, 4.5, 5.0, 5.5, 6.0, 6.5, 7.0, 7.5, or 8.0 inches, or by another suitable distance. Additionally and/or alternatively, the diffuser 14 can be somewhat flat or dome shaped, and can be frosted and/or include various colors or designs in order to provide a desired ambience and/or to promote a particular holiday, occasion, sports team, fictional character, cause, etc.

As provided above, the diffuser 14 is designed to be selectively attached to and detached from the base assembly 12. Additionally, the diffuser 14 can be quickly and easily interchanged on the base assembly 12 with one or more additional diffusers, e.g., the diffuser 214 illustrated in FIGS. 2A-2D and/or the diffuser 314 illustrated in FIGS. 3A and 3B. In the embodiment illustrated in FIGS. 1A-1E, the diffuser 14 is in the shape of a snowman, which can be used for decorative purposes during wintertime, around the Christmas holiday season, and/or at any time desired by the user. As noted, additional diffusers can include shapes and sizes that are appropriate for celebrating holidays, birthdays or other occasions, or for supporting favorite teams, fictional characters or causes; and/or additional diffusers can comprise a frosted and/or colored dome that provides a desired ambience.

Additionally, in this embodiment, the diffuser 14, when attached to the base assembly 12, is designed to be positioned in a generally upright position on the surface 15, such as a table top, a counter top, or some other surface.

Further, in certain embodiments, the diffuser 14 can be made from a durable, molded plastic material and can include various different colors to provide the desired shapes, sizes and designs. Alternatively, the diffuser 14 can be made from other suitable materials.

Figure 2A:
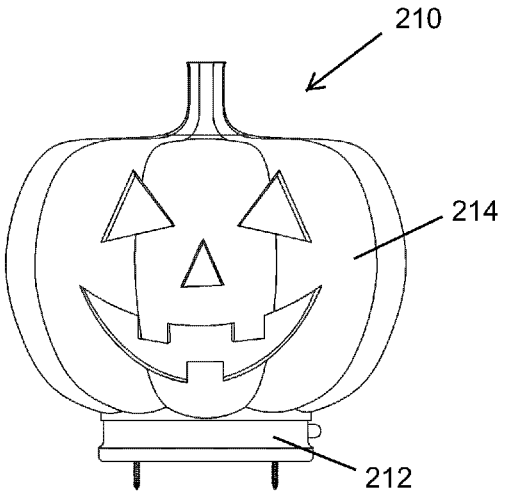
FIG. 2A is a simplified front view of another embodiment of a surface mount light having features of the present invention.
Figure 2B:
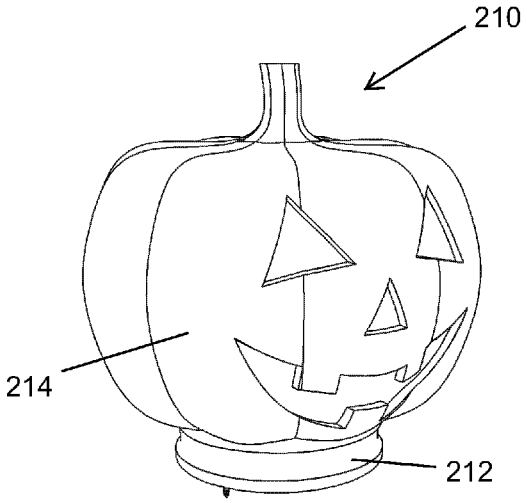
FIG. 2B is a simplified perspective view of the surface mount light illustrated in FIG. 2A.
Figure 2C:
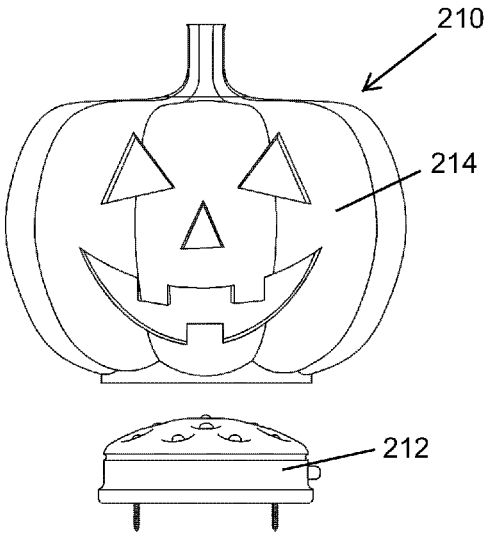
FIG. 2C is a partially exploded front view of the surface mount light illustrated in FIG. 2A.
Figure 2D:
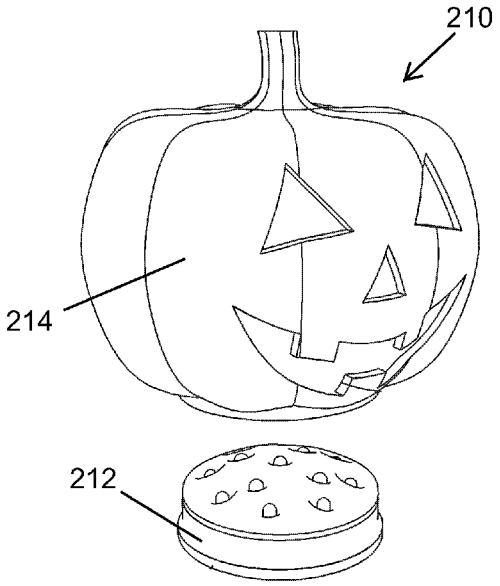
FIG. 2D is a partially exploded perspective view of the surface mount light illustrated in FIG. 2A.

FIGS. 2A-2D are alternative views of another embodiment of a surface mount light 210 having features of the present invention. More particularly, FIG. 2A is a simplified front view of the surface mount light 210; FIG. 2B is a simplified perspective view of the surface mount light 210 illustrated in FIG. 2A; FIG. 2C is a partially exploded front view of the surface mount light 210 illustrated in FIG. 2A; and FIG. 2D is a partially exploded perspective view of the surface mount light 210 illustrated in FIG. 2A.

In this embodiment, the diffuser 214 is in the shape of a pumpkin or jack-o-lantern that is selectively attachable to and detachable from the base assembly 212. Additionally, as with the previous embodiment, the diffuser 214, when attached to the base assembly 212, is designed to be positioned in a generally upright position on a surface, such as a table top, a counter top, or some other surface.

Figure 3A:
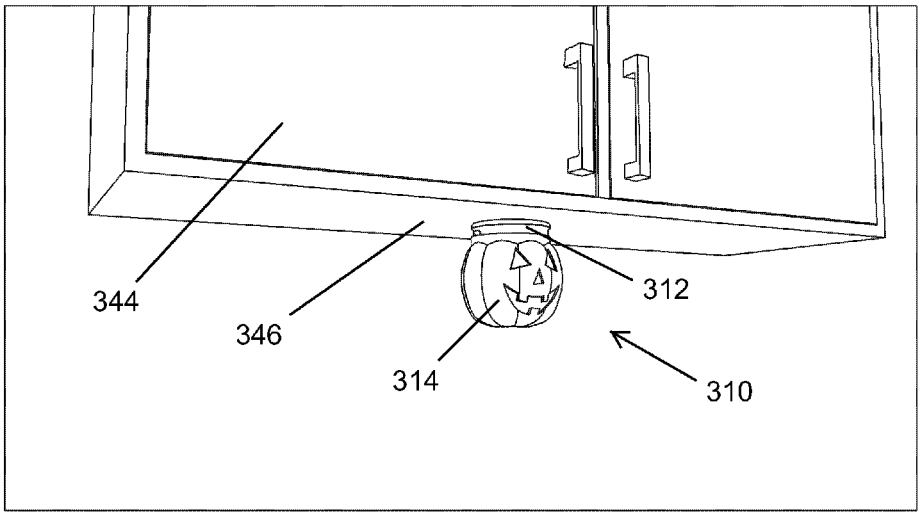
FIG. 3A is a simplified perspective view of a portion of a cabinet and still another embodiment of a surface mount light having features of the present invention.
Figure 3B:
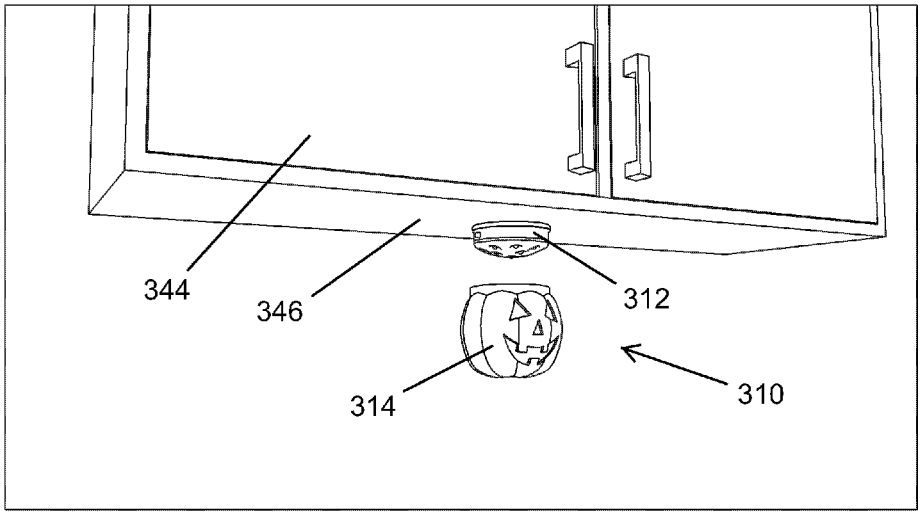
FIG. 3B is a partially exploded perspective view of the portion of the cabinet and the surface mount light illustrated in FIG. 3A.

FIGS. 3A and 3B are alternative views of a portion of a cabinet 344 and still another embodiment of a surface mount light 310 having features of the present invention. In particular, FIG. 3A is a simplified perspective view of the portion of the cabinet 344 and the surface mount light 310, wherein the diffuser 314 is attached to the base assembly 312; and FIG. 3B is a partially exploded perspective view of the portion of the cabinet 344 and the surface mount light 310 illustrated in FIG. 3A, wherein the diffuser 314 is detached from the base assembly 314.

In this embodiment, the diffuser 314 is again in the shape of a pumpkin or jack-o-lantern that is selectively attachable to and detachable from the base assembly 312. However, as illustrated in this embodiment, the diffuser 314, when attached to the base assembly 312, is designed to be positioned so that the diffuser 314 extends in a generally downward direction from an underside 346 of the cabinet 344, or other generally downward facing surface.

Figure 4:
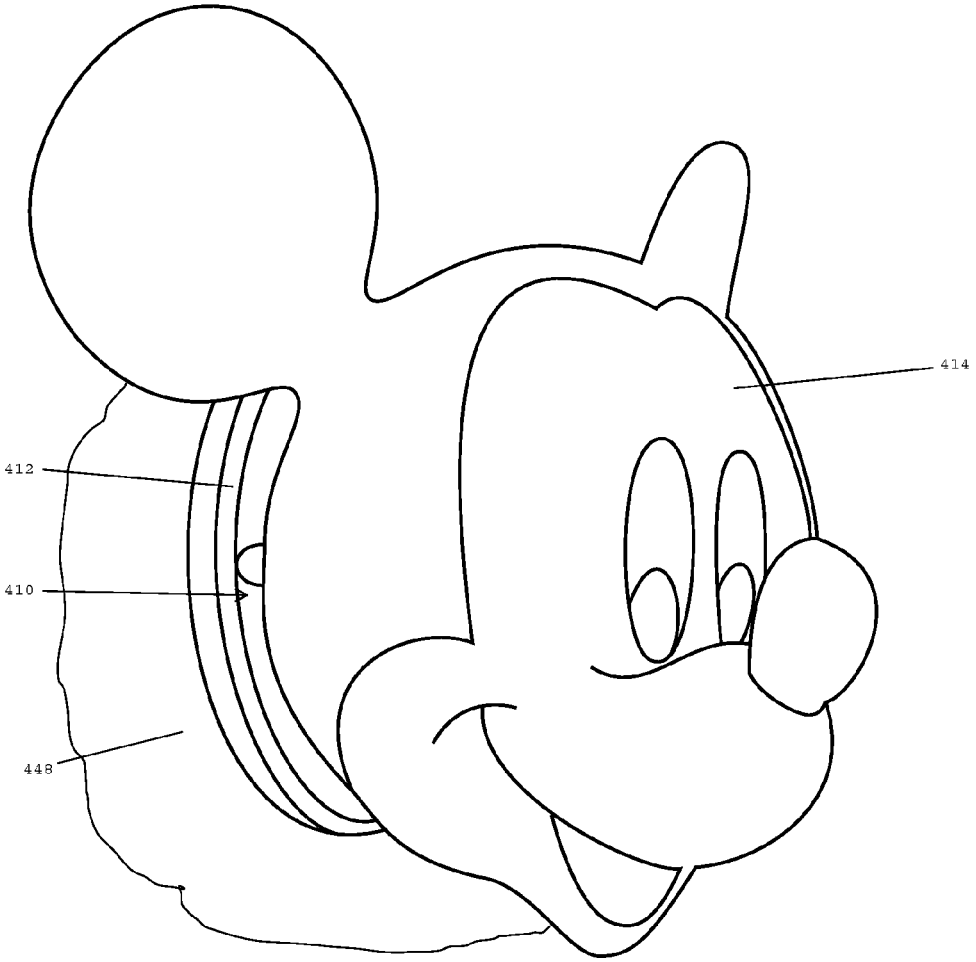
FIG. 4 is a perspective view of a portion of a wall and yet another embodiment of a surface mount light having features of the present invention.

FIG. 4 is a perspective view of a portion of a wall 448 and yet another embodiment of a surface mount light 410 having features of the present invention. In this embodiment, the surface mount light 410 comprises a wall-mount configuration. More particularly, the surface mount light 410 includes the base assembly 412 and the diffuser 414, with the base assembly 412 being secured to and/or mounted on the wall 448, and the diffuser 414 being oriented such that the subject of the diffuser 414 is positioned in a generally upright configuration as the diffuser 414 extends away from the wall 448. Additionally, in this embodiment, the diffuser 414 is shown as a decorative diffuser that is representative of a fictional, animated character, i.e. Mickey Mouse in the particular embodiment. Alternatively, the diffuser 414 can be a different type of decorative diffuser, or another type of diffuser.

Figure 5:
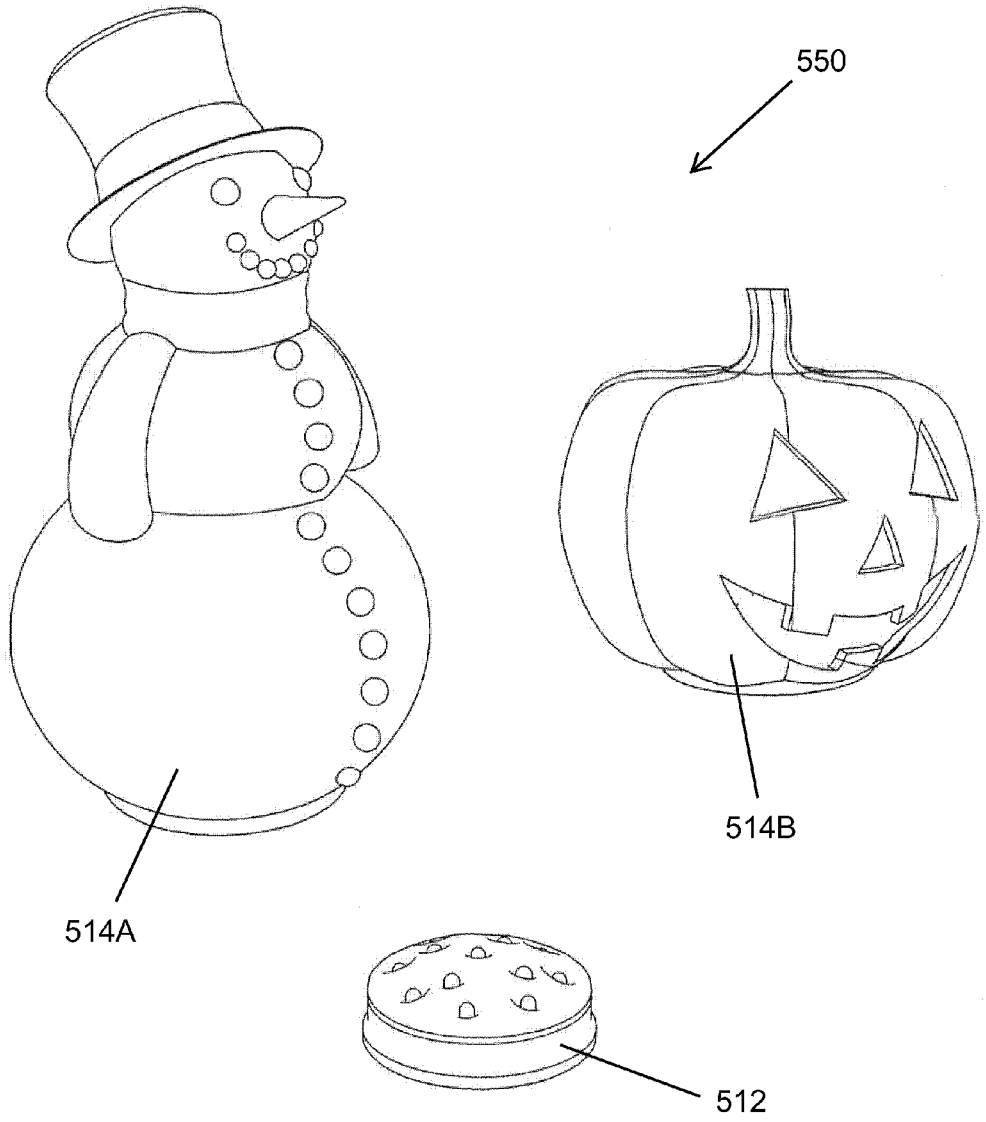
FIG. 5 is a perspective view of a package assembly having features of the present invention.

FIG. 5 is a perspective view of a package assembly 550 having features of the present invention. In particular, FIG. 5 illustrates that the package assembly 550 includes a base assembly 512 and a plurality of diffusers, e.g., a first diffuser 514A and a second diffuser 514B. The base assembly 512 is substantially similar to the base assemblies 12, 212, 312, 412 illustrated and described herein above; therefore, a detailed description of the base assembly 512 will not be provided herein. Additionally, the diffusers 514A, 514B are substantially similar to the diffusers 14, 214, 314, 414 illustrated and described herein above; therefore a detailed description of the diffusers 514A, 514B will not be provided herein.

In this embodiment, each of the plurality of diffusers 514A, 514B are selectively and alternatively attachable to and detachable from the base assembly 512, without damaging the base assembly 512 and/or the diffusers 514A, 514B.

While a number of exemplary aspects and embodiments of a surface mount light 10 have been shown and disclosed herein above, those of skill in the art will recognize certain modifications, permutations, additions and sub-combinations thereof. It is therefore intended that the surface mount light 10 shall be interpreted to include all such modifications, permutations, additions and sub-combinations as are within their true spirit and scope, and no limitations are intended to the details of construction or design herein shown.

What is claimed is:

1. A surface mount light that is mounted on a surface, the surface mount light comprising:

a base assembly including (i) a housing body having a base and a side that is coupled to the base, the base being adapted to be mounted on the surface; (ii) a light assembly that is positioned substantially within the housing body, the light assembly including one or more LED lights, wherein power is selectively provided to the light assembly such that at least one of the one or more LED lights directs light away from the base; and (iii) a first attachment member; and a first diffuser that can be selectively attached to and detached from the base assembly without damaging the base assembly and the first diffuser, the first diffuser including a second attachment member that selectively engages the first attachment member so that the first diffuser is selectively attachable to the base assembly.

2. The surface mount light of claim 1 wherein the housing body is substantially disk shaped.

3. The surface mount light of claim 2 wherein the housing body has a diameter of less than approximately five inches.

4. The surface mount light of claim 1 wherein the first diffuser is a decorative diffuser that extends away from the base assembly by at least approximately two inches.

5. A package assembly including the surface mount light of claim 1 further comprising a second diffuser that is selectively attachable to and detachable from the base assembly.

6. The surface mount light of claim 1 wherein the first attachment member includes a groove that extends around a perimeter of the housing body, and wherein the second attachment member includes one or more protrusions that can be selectively positioned within the groove.

7. The surface mount light of claim 1 further comprising a sound source positioned substantially within the housing body.

8. The surface mount light of claim 1 further comprising a switch that selectively activates the light assembly.

9. The surface mount light of claim 8 further comprising a sound source positioned substantially within the housing body, and wherein the switch selectively activates the sound source.

10. The surface mount light of claim 1 further comprising a power source assembly including one or more batteries that selectively provide power to the light assembly such that at least one of the one or more LED lights directs light away from the base.

11. A package assembly including the surface mount light of claim 1, and a second diffuser that is alternatively selectively attachable to and detachable from the base assembly without damaging the base assembly and the second diffuser.

12. A surface mount light that is mounted on a surface, the surface mount light comprising:

a base assembly including (i) a housing body having a base and a side that is coupled to the base, the base being adapted to be mounted on the surface; (ii) a light assembly that is positioned substantially within the housing body, the light assembly including one or more LED lights; (iii) a power source assembly that provides power to the light assembly such that at least one of the one or more LED lights directs light away from the base; and (iv) a first attachment member;

a sound source that is positioned substantially within the housing body, the power source assembly providing power to the sound source to selectively activate the sound source;

a first diffuser that is selectively attachable to and detachable from the base assembly without damaging the base assembly and the first diffuser, the first diffuser including a second attachment member that selectively engages the first attachment member so that the first diffuser is selectively attachable to the base assembly; and a second diffuser that is selectively attachable to and detachable from the base assembly without damaging the base assembly and the second diffuser.

* * * * *